US007513737B2

(12) United States Patent
Daux et al.

(10) Patent No.: US 7,513,737 B2
(45) Date of Patent: Apr. 7, 2009

(54) GAS TURBINE BLADE COOLING CIRCUIT HAVING A CAVITY WITH A HIGH ASPECT RATIO

(75) Inventors: Stéphan Daux, Montgeron (FR); Chantal Giot, Combs la Ville (FR); Hugues Joubert, Paris (FR); Benjamin Sauthier, Montrouge (FR)

(73) Assignee: Snecma, Paris (FR)

( * ) Notice: Subject to any disclaimer, the term of this patent is extended or adjusted under 35 U.S.C. 154(b) by 561 days.

(21) Appl. No.: 11/131,200

(22) Filed: May 18, 2005

(65) Prior Publication Data

US 2005/0260076 A1 Nov. 24, 2005

(30) Foreign Application Priority Data

May 18, 2004 (FR) ..... 04 05397

(51) Int. Cl.
*B63H 1/14* (2006.01)

(52) U.S. Cl. ..... 415/115; 416/97 R

(58) Field of Classification Search ..... 415/115; 416/97 R

See application file for complete search history.

(56) References Cited

U.S. PATENT DOCUMENTS 4,142,824 A * 3/1979 Andersen ..... 415/115
6,142,734 A * 11/2000 Lee ..... 416/97 R
6,504,274 B2 * 1/2003 Bunker et al. ..... 310/64
6,589,600 B1 * 7/2003 Hasz et al. ..... 427/264
6,644,921 B2 11/2003 Bunker et al.
7,302,990 B2 * 12/2007 Bunker et al. ..... 164/28
2004/0052643 A1 3/2004 Bunker

FOREIGN PATENT DOCUMENTS

| | | |
|---|---|---|
| EP | 1 065 345 | 1/2001 |
| EP | 1 116 537 | 7/2001 |
| WO | WO-99/64791 | 12/1999 |
| WO | WO-01/71164 | 9/2001 |

OTHER PUBLICATIONS

International Search Report No. FR 0405397 FA 651096, dated Jan. 7, 2005, 2 pages.

* cited by examiner

*Primary Examiner*—Igor Kershteyn
(74) *Attorney, Agent, or Firm*—Oblon, Spivak, McClelland, Maier & Neustadt, P.C.

(57) ABSTRACT

A blade for a turbomachine gas turbine, the blade having a cooling circuit comprising at least one cooling cavity with a high aspect ratio extending radially between a root and a tip of the blade, and at least one air admission opening at a radially inner end of the cavity to feed it with cooling air, at least one of the walls of the cooling cavity being provided with a plurality of indentations so as to disturb the flow of cooling air in said cavity and increase heat exchange.

19 Claims, 2 Drawing Sheets

GAS TURBINE BLADE COOLING CIRCUIT HAVING A CAVITY WITH A HIGH ASPECT RATIO

BACKGROUND OF THE INVENTION

The present invention relates to the general field of cooling blades in turbomachine gas turbines. More particularly it seeks to improve the cooling of a blade provided with a cooling cavity having a high aspect ratio.

It is known to provide the moving blades of a turbomachine gas turbine, such as the high and low pressure turbines, with internal cooling circuits enabling them to withstand without damage the very high temperatures to which they are subjected while the turbomachine is in operation. For example, in a high pressure turbine, the temperature of the gas coming from the combustion chamber reaches values well above those that can be withstood without damage by the moving blades of the turbine, which has the consequence of limiting their lifetime.

By means of internal cooling circuits, air which is generally injected into the blade by its root, travels along the blade, following a path formed by cavities made inside the blade, prior to being ejected through orifices opening out into the surface of the blade.

Nevertheless, those cooling circuits are unsuitable for blades that are "long and thin", i.e. blades presenting a thickness (maximum distance between the pressure side face and suction side face of the blade) that is considerably smaller than their radial height (distance between the root and the tip of the blade).

One of the constraints associated with such blades is the small air flow rate available for cooling them. This means that it is necessary to adopt a cooling cavity that is fine, i.e. that has a high aspect ratio, in order to increase the internal air flow speed, and thus increase heat exchange coefficients. Since such a modification is not sufficient for cooling the blade, it is also necessary to disturb the internal flow, e.g. by means of spike or bridge type flow disturbers.

Nevertheless, the use of conventional disturbers is made impossible by the fineness of the cooling cavity in such blades. In particular, the presence of spikes in the cooling cavity impedes the flow of air passing therethrough excessively and leads to reduced mechanical strength which is a source of crack starters. Bridges also raise problems of fabrication when casting blades.

OBJECT AND SUMMARY OF THE INVENTION

A main object of the invention is thus to mitigate such drawbacks by proposing a cooling cavity for a gas turbine blade, and more particularly a blade of the "long and thin" type, enabling the blade to be cooled effectively and that is easy to fabricate.

To this end, the invention provides a blade for a turbomachine gas turbine, the blade having a cooling circuit comprising at least one cooling cavity with a high aspect ratio extending radially between a root and a tip of the blade, and at least one air admission opening at a radially inner end of the cavity to feed it with cooling air, wherein at least one of the walls of the cooling cavity is provided with a plurality of indentations so as to disturb the flow of cooling air in said cavity and increase heat exchange.

A cooling cavity is considered as having a high aspect ratio when, in cross-section, it presents a camber dimension or length that is at least three times greater than its width dimension.

Unlike conventional flow disturbers of the spike or bridge type, the indentations are patterns constituted by recesses in material. Such indentations thus enable the internal flow to be disturbed without that obstructing it. The cooling circuit of the blade of the invention also makes it possible to obtain effective cooling of the blade with lower head losses and small stress concentrations, so it leads to better mechanical strength. Such a blade is also simpler to fabricate since its cooling circuit can easily be obtained by performing a casting operation.

The walls of the cooling cavity may advantageously have no flow disturber patterns constituted by added matter of the spike or bridge type. The presence of indentations in at least one of the walls of the cooling cavity suffices to disturb the internal flow of air travelling therealong.

More particularly, the cooling circuit need not include any emission of air through the faces of the blade. Under such circumstances, the air flowing in the cooling cavity is exhausted through the tip of the blade.

The present invention applies preferably to a blade having a ratio of its thickness over its radial height between the root and the tip lying in the range 0.01 to 0.25.

The blade may also present a ratio of the depth of the indentations over the width of the cooling cavity lying in the range 0.15 to 0.65.

In order to ensure that cooling is uniform, the indentations may be formed in the walls of the cooling cavity on the pressure side and on the suction side of the blade. They may be substantially in alignment parallel to a radial axis of the blade, or they may be disposed in a configuration that is staggered relative to said axis. Furthermore, they may be formed over a fraction of the blade only, e.g. over a lower portion thereof.

The indentations in the cooling cavity may be substantially spherical or conical in shape.

BRIEF DESCRIPTION OF THE DRAWINGS

Other characteristics and advantages of the present invention appear from the following description made with reference to the accompanying drawings which show an embodiment having no limiting character. In the figures.

DETAILED DESCRIPTION OF AN EMBODIMENT

Figure 1:
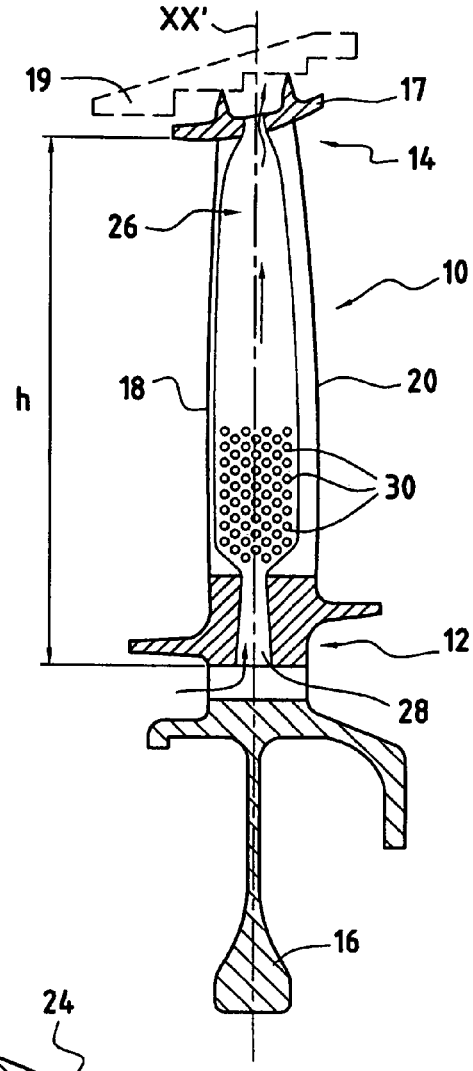
FIG. 1 is a longitudinal section view of a turbine blade of the invention.
Figure 2:
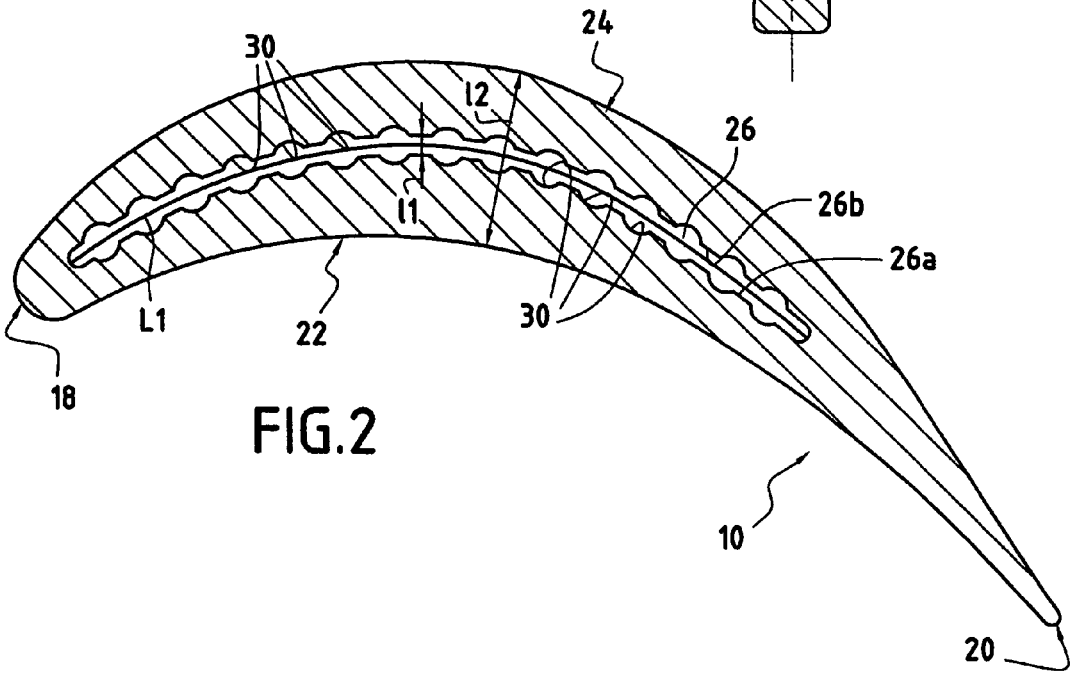
FIG. 2 is a cross-section view of the FIG. 1 blade.

The blade 10 having a radial axis XX' and shown in FIGS. 1 and 2 is a moving blade of a high pressure turbine in a turbomachine. Naturally, the invention can also be applied to other blades in the turbomachine, for example to the blades of its low pressure turbine.

The blade 10 comprises an airfoil surface (or blade proper) which extends radially between a blade root 12 and a blade tip 14. The blade root 12 is for mounting on a disk 16 of the rotor of the high pressure turbine. As shown in FIG. 1, the blade tip 14 may have sealing wipers 17 disposed facing an abradable covering 19 fitted to the casing (not shown) of the high pressure turbine.

The airfoil surface presents four distinct zones: a leading edge 18 disposed facing the flow of hot gas coming from the combustion chamber of the turbomachine; a trailing edge 20 remote from the leading edge 18; a pressure side face 22; and a suction side face 24, these side faces 22 and 24 interconnecting the leading edge 18 and the trailing edge 20.

The blade 10 is provided with a cooling circuit having at least one cooling cavity 26 of high aspect ratio extending radially between the root 12 and the tip 14 of the blade, and at least one air admission opening 28 at a radially inner end of the cavity 26 (i.e. in the blade root 12) in order to feed it with cooling air.

The term "high aspect ratio" is used of the cavity to mean that the cavity presents, in cross-section, a length of camber dimension L1 that is at least three times, and preferably at least five times, greater than its width dimension l1. This characteristic of the cavity 26 can be seen more particularly in FIG. 2.

As shown in FIG. 2, the cooling cavity 26 is defined by a pressure side wall 26*a* on the pressure side 22 of the blade and by a suction side wall 26*b* on the suction side 24 of the blade. These walls 26*a* and 26*b* join at the two axial ends of the cavity 26 and the distance between them represents the width l1 of the cavity.

The cooling circuit of the blade 10 shown in FIGS. 1 and 2 has a single cavity 26 extending axially from the leading edge 28 to the trailing edge 20 of the blade. Nevertheless, it is possible to devise a blade having a plurality of cooling cavities each of high aspect ratio.

In the invention, at least one of the walls 26*a*, 26*b* of the cooling cavity 26 of the blade 10 is provided with a plurality of indentations 30 so as to disturb the flow of cooling air inside the cavity and increase heat exchange. The indentations 30 (or recesses) are flow-disturbing patterns of removed material, i.e. they do not require any material to be added.

In the example of FIG. 2, both walls 26*a*, 26*b* of the cavity 26 are provided with indentations 30. Nevertheless, it is also possible for indentations to be formed in only one of them.

According to a particularly advantageous characteristic of the invention, the walls 26*a*, 26*b* of the cooling cavity 26 do not have any flow disturbing patterns made of added material. For example, the walls 26*a*, 26*b* of the cavity 26 do not include any flow disturbers of the spike or bridge type. The sole presence of the indentations 30 suffices to cool the blade 10 effectively.

According to another advantageous characteristic of the invention, the blade cooling circuit does not emit any air through the faces of the blade 10 (i.e. through the pressure side face 22 or the suction side face 24, or indeed through the leading edge 18 or the trailing edge 20 thereof).

In this configuration, all of the cooling air flowing in the cavity of the cooling circuit is exhausted via the blade tip 14, e.g. in the vicinity of the sealing wipers 17. In addition, if the cooling circuit has a plurality of high aspect ratio cavities, they are preferably mutually independent: each of them being fed individually with air from the blade root 12 and with all of the air flowing in each of them being exhausted through the blade tip 14.

The invention is preferably applied to a "long and thin" blade 10 as shown in FIG. 1, i.e. presenting a ratio of thickness l2 (the maximum distance between the pressure side face 22 and the suction side face 24 of the blade as shown in FIG. 2 (also known as the maximum cross-section)) over its radial height h (FIG. 1) between the root 12 and the tip 14 of the blade lying in the range 0.01 to 0.25.

Figure 5:
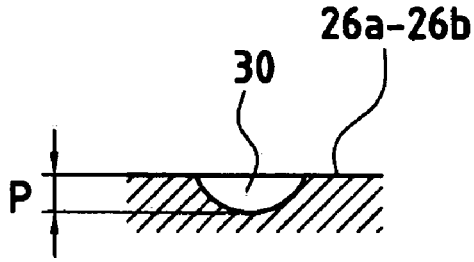
FIGS. 5 and 6 are cross-section views showing different shapes of indentation for the cooling circuit of the blade of the invention.

According to another advantageous characteristic of the invention, the blade 10 presents a ratio between the depth P of the indentations 30 (FIGS. 5 and 6) and the width l1 of the cooling cavity 26 (FIG. 2) lying in the range 0.15 to 0.65.

Figure 3:
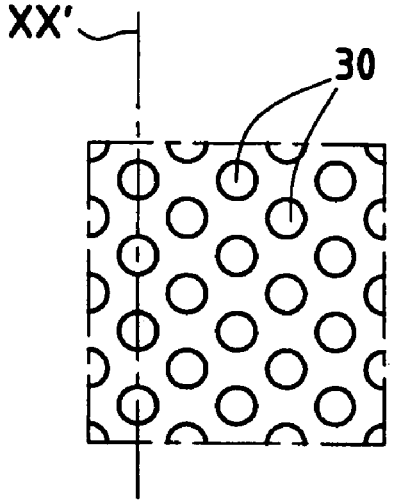
FIGS. 3 and 4 show different dispositions of the indentations of the blade cooling circuit of the invention.
Figure 4:
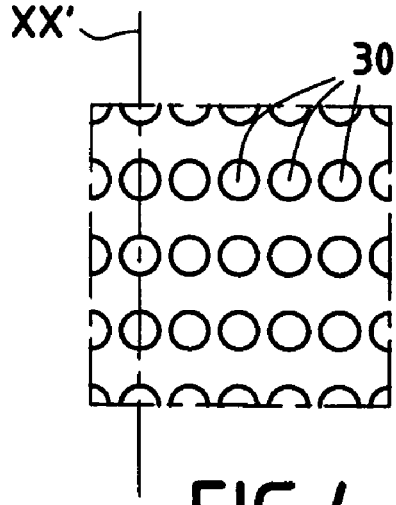

The indentations 30 in the cooling cavity 26 of the blade 10 may be disposed in a staggered configuration relative to the radial axis XX' of the blade (FIGS. 1 and 3). Alternatively, the indentations 30 of the cooling cavity 26 may be substantially in alignment parallel with the radial axis XX' of the blade (FIG. 4).

In addition, and as shown in FIG. 1, the indentations 30 of the cooling cavity 26 can be formed solely in a bottom portion of the blade 10, e.g. out to a radial height representing abut 30% of the total radial height h of the blade between its root 20 and its tip 14. Naturally, the indentations may also be formed over all or some other fraction of the radial height of the blade.

Figure 6:
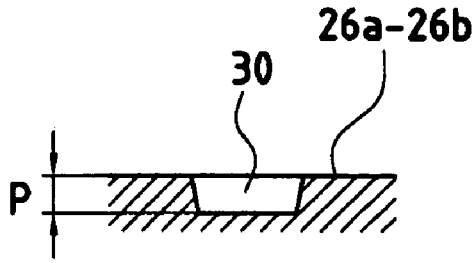

The indentations 30 of the cooling cavity 26 may be of shape that is substantially spherical (FIG. 5) or substantially conical (FIG. 6). It is also possible to devise any other shape for their section: square, cylindrical, water drop, etc.

The size, the depth P, and the spacing between two adjacent indentations 30 can likewise be varied depending on the extent of disturbance it is desired to obtain.

What is claimed is:

1. A blade for a turbomachine gas turbine, the blade including a cooling circuit comprising:

at least one cooling cavity with a high aspect ratio extending radially between a root and a tip of the blade such that said cooling cavity has, in cross-section, a length of camber that is at least three times greater than a width of said cooling cavity, and at least one air admission opening at a radially inner end of the cooling cavity to feed said cooling cavity with cooling air, wherein at least one of the walls of the cooling cavity is provided with a plurality of indentations over a first portion of the radial height of the blade so as to disturb a flow of cooling air in said cooling cavity and increase heat exchange, and said wall is free of said indentations over a second portion of the radial height of the blade different from the first portion.

2. A blade according to claim 1, wherein the walls of the cooling cavity do not have any flow-disturbing patterns of added material.

3. A blade according to claim 1, wherein the cooling circuit does not eject any air through the faces of the blade.

4. A blade according to claim 1, wherein the blade presents a ratio of a thickness of said blade over a radial height of said blade between the root and the tip lying in the range 0.01 to 0.25.

5. A blade according to claim 1, wherein the blade presents a ratio of a depth of the indentations over the width of the cooling cavity lying in the range 0.15 to 0.65.

6. A blade according to claim 1, wherein the indentations of the cooling cavity are substantially in alignment parallel with a radial axis of the blade.

7. A blade according to claim 1, wherein the indentations of the cooling cavity are disposed in a staggered configuration relative to a radial axis of the blade.

8. A blade according to claim 1, wherein the indentations are formed in the walls of the cooling cavity on the pressure side and on the suction side of the blade.

9. A blade according to claim 1, wherein the indentations of the cooling cavity are formed in a lower portion of the blade.

10. A blade according to claim 1, wherein the indentations of the cooling cavity are of substantially spherical shape.

11. A blade according to claim 1, wherein the indentations of the cooling cavity are of substantially conical shape.

12. A blade according to claim 1, wherein said indentations are recesses of removed material of said blade formed in said at least one wall of said cooling cavity and said at least one wall of said cooling cavity is free of any added material.

13. A blade according to claim 1, wherein said width of said cooling cavity is a minimum distance between a pressure side wall of said cooling cavity and a suction side wall of said cooling cavity, wherein said minimum distance is measured between a pressure side wall point located between indentations on said pressure side wall and a suction side wall point located between indentations on said suction side wall.

14. A blade according to claim 13, wherein said cross-section is within a plane perpendicular to a radial axis of the blade, and said length of camber extends curvilinearly within said plane from a leading edge end of said cooling cavity to a trailing edge end of said cooling cavity.

15. A blade according to claim 4, wherein said thickness is a maximum distance between a pressure side face of said blade and a suction side face of the blade.

16. A blade according to claim 3, wherein the cooling cavity is configured such that all of said cooling air fed into said cooling cavity exhausts via the tip of the blade.

17. A blade according to claim 1, wherein the second portion of the radial height of the blade extends along no less than 70 percent of the height of the blade, measured radially inward from the top of the blade.

18. A blade according to claim 1, wherein the blade is installed in a low pressure turbine module.

19. A blade according to claim 18, wherein the blade includes a sealing wiper at a tip of the blade.

* * * * *